US006065183A

United States Patent [19]

Hammeken et al.

[11] Patent Number: 6,065,183

[45] Date of Patent: May 23, 2000

[54] CONNECTION ELEMENT FOR A MOUTHPIECE

[75] Inventors: Nils Preben Hammeken, Holte, Denmark; Benny Matthiassen, Madison, Wis.

[73] Assignee: Nilfisk A/S, Brodby, Denmark

[21] Appl. No.: 09/051,427

[22] PCT Filed: Oct. 14, 1996

[86] PCT No.: PCT/DK96/00439

§ 371 Date: Aug. 13, 1998

§ 102(e) Date: Aug. 13, 1998

[87] PCT Pub. No.: WO97/13445

PCT Pub. Date: Apr. 17, 1997

[30] Foreign Application Priority Data

Oct. 12, 1995 [DK] Denmark ..... 1147/95

[51] Int. Cl.[7] ..... A47L 9/02

[52] U.S. Cl. ..... 15/411; 15/415.1

[58] Field of Search ..... 15/411, 415.1, 15/410

[56] References Cited

U.S. PATENT DOCUMENTS

| | | | |
|---|---|---|---|
| 1,086,367 | 2/1914 | Hope | 15/411 X |
| 1,161,908 | 11/1915 | Tice | 15/411 |
| 1,318,881 | 10/1919 | Kelley | 15/411 X |
| 1,355,553 | 10/1920 | Goughnour | 15/411 |
| 1,838,481 | 12/1931 | Gudka | 15/411 X |
| 2,974,347 | 3/1961 | Seyfried | 15/411 X |
| 5,410,776 | 5/1995 | Schneider | 15/415.1 X |

FOREIGN PATENT DOCUMENTS

| | | | |
|---|---|---|---|
| 621996 | 11/1935 | Germany . | |
| 104383 | 4/1942 | Sweden | 15/415.1 |
| 8403429 | 9/1984 | WIPO . | |

*Primary Examiner*—Chris K. Moore
*Attorney, Agent, or Firm*—Ladas & Parry

[57] ABSTRACT

A connecting element for coupling of the suction pipe (3) of a suction cleaner to a mouthpiece (2) having a suction sole (9) with an abutment surface (10) and an elongated suction slot which debouches on the abutment surface (10) of the suction sole (9), and wherein the connecting element comprises flexible joints (4, 5, 7, 8) which may transmit an angle change of the suction pipe (3) of the vacuum cleaner about the longitudinal axis of the suction pipe to a rotation of the vacuum cleaner mouthpiece in the plane of the abutment surface (10), and also allows a freedom of movement between the vacuum cleaner mouthpiece (2) and the vacuum cleaner suction pipe (3) whereby the abutment surface may freely assume different orientations relative to the longitudinal axis of the suction pipe. According to the invention the flexible joint has a freedom of movement which allows the suction pipe to be freely movable about an axis **(8*a*) which is parallel with the suction slot in an angle (α) outwards to both sides of a plane (11) which is perpendicular to the plane of the abutment surface (10) and extends along and through the elongated suction slot, and the suction pipe (3) has or may assume an angle (β) in the plane (11) which is perpendicular to the plane of the abutment surface (10), said angle (β) being, relative to the plane (10)** of the abutment surface, less than 80°.

10 Claims, 3 Drawing Sheets

CONNECTION ELEMENT FOR A MOUTHPIECE

FIELD OF THE INVENTION

The present invention relates to a connecting element for a mouthpiece for use in connection with a suction cleaner, said mouthpiece being of the type which is designed for arrangement at the end of e.g. the suction pipe of a vacuum cleaner, and wherein the mouthpiece is provided with a suction sole for sweeping a supporting surface, such as a floor. More specifically the invention relates to a connecting element of the type featured in the introductory part of claim 1.

BACKGROUND OF INVENTION

Such mouthpieces which may e.g. be intended for vacuum cleaning are usually provided with a flexible joint that connects the suction sole to the suction pipe of the vacuum cleaner, said connecting joint being so designed that the vacuum cleaner mouthpiece may freely occupy different angles relative to the vacuum cleaner mouthpiece. In this manner the suction sole of the vacuum cleaner mouthpiece may easily sweep a surface irrespective of the orientation of the suction pipe of the suction cleaner.

Owing to the construction of the flexible joint, the known vacuum cleaner mouthpieces of this type allow the mouthpiece to be turned in the surface plane during use by rotation of the vacuum cleaner's suction pipe about its longitudinal axis. On the one hand, it is desired in this connection that it is possible to turn the mouthpiece slightly in order to access inaccessible places, and on the other hand that the mouthpiece may be turned with a small effort on the part of the user, whereby an impact on the vacuum cleaner mouthpiece, e.g. when bumping into furniture and the like during use, will entail a relatively small moment of force on the suction pipe.

Therefore the known joints are so arranged that a given angle change in the position of the vacuum cleaner suction pipe entails a relatively smaller angle change of the mouthpiece in the surface plane. Very often such that the angle change of the mouthpiece is about half the angle change of the suction pipe of the vacuum cleaner. Hereby it becomes possible, as mentioned above, to orient the mouthpiece in the surface plane with only little effort due to the exchange in the flexible joint. However, in case a more drastic angle change is imposed on the known mouthpiece, an undesired leak will occur between the suction sole and the supporting surface which is vacuum-cleaned.

An example of such known mouthpiece is described in W084/03429.

It is a drawback of the known mouthpieces that the forward and backward movements to be performed by the vacuum cleaner operator often entail a hunched and thus inconvenient work posture which strains the back of the operator.

SUMMARY OF INVENTION

It is therefore the object of the present invention to provide a connecting element for a mouthpiece for suction-cleaning floors and the like surfaces, said connecting element enabling cleaning by suction of a large area, as opposed to the known ones, at a given time consumption while occupying an ergonomically more correct work posture.

This is obtained by the invention according to claim 1 since it is hereby made possible to suction-clean or especially to vacuum-clean by moving the mouthpiece from side to side relative to the user's position as opposed to the known movement of the mouthpiece in a direction away from and towards the user. Compared to the known mouthpieces, the sideways movement of the mouthpiece will, ceteris paribus, provide a higher average rate of sweeping whereby, at a given time consumption, an area is swept which is considerably larger than by means of the known mouthpieces without causing the user to occupy a more hunched and thus more back-straining work posture. This high degree of movability which is provided with the present invention also makes it possible to occupy not substantially different work postures compared to the previously known ones.

In order to obtain a particularly high degree of vacuum cleaning efficiency, it is preferred that the suction pipe may occupy an angle of at least 30 degrees and preferably of more than 45 degrees as defined in claim 2.

Conveniently the operating range of the suction pipe is symmetrical in one preferred embodiment, as the mouthpiece will act substantially the same irrespective of its orientation relative to the user, which makes it equally suitable for right-handed and left-handed users as well as for forward and backward suction cleaning.

In other preferred embodiments the flexible joint consists of a homokinetic joint or a cardan joint In a particularly convenient embodiment of such cardan joint, the axes of the cardan joint are displaced relative to each other, and the axis which is most proximate to the suction slot is substantially parallel with the suction slot. This allows for a very high degree of movability between mouthpiece and suction pipe while simultaneously minimising the risk of tipping the mouthpiece during vacuum cleaning.

The cardan joint being provided in a further embodiment provides good protection of the flexible hose between the suction pipe and the suction slot against mechanical influence.

In a convenient embodiment, wherein at least the suction sole of the mouthpiece can be separated from the flexible joint which may permanently secure the joint to the suction pipe of the vacuum cleaner, or which may optionally be replaced by another joint.

BRIEF DESCRIPTION OF THE DRAWINGS

Preferred embodiments of the invention will be described in further detail in the following with reference to the drawings, wherein.

DETAILED DESCRIPTION

Figure 1:
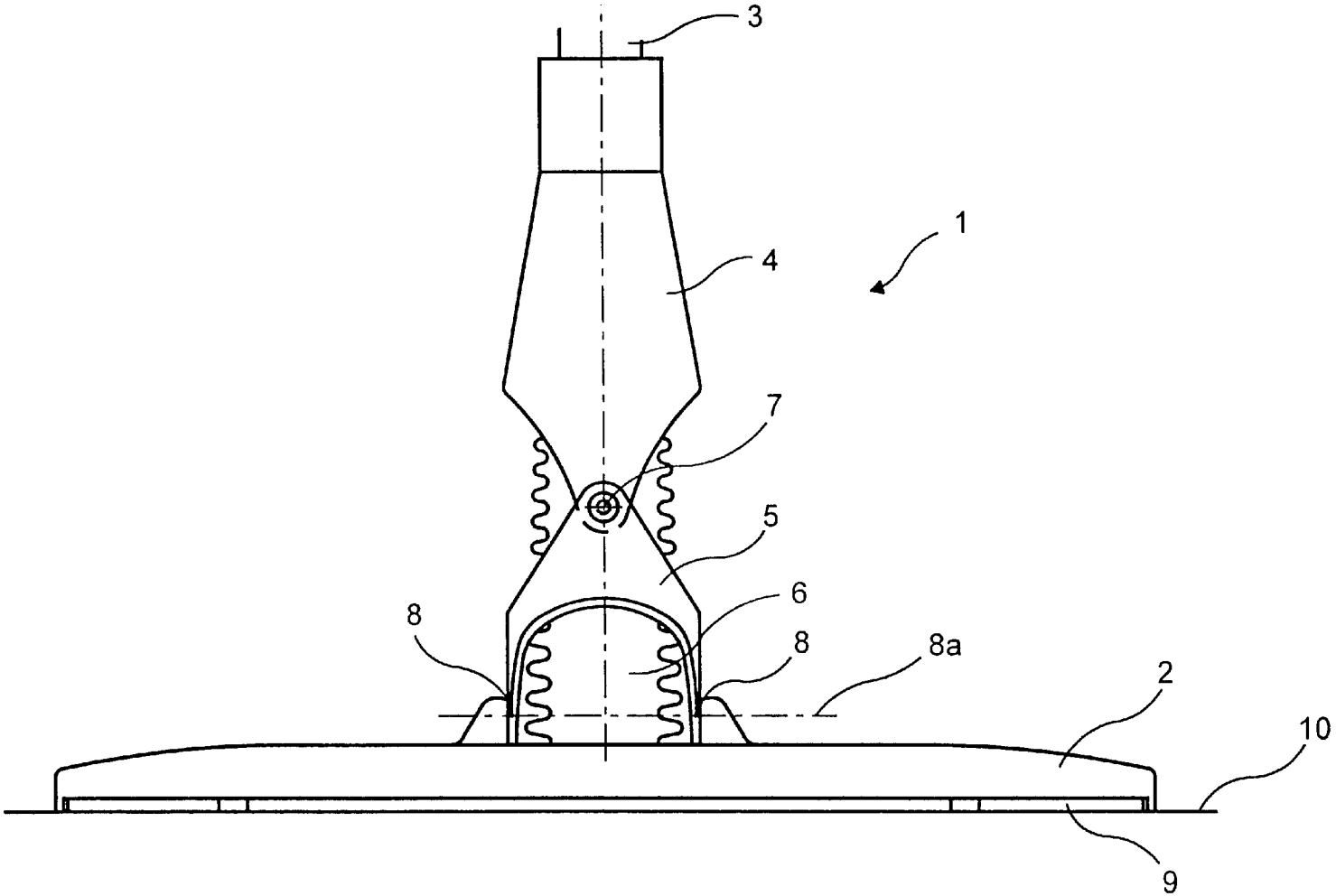
FIG. 1 is a front view of an embodiment of a vacuum cleaner mouthpiece according to the invention.

Thus, FIG. 1 illustrates a vacuum cleaner mouthpiece 1 which comprises, conventionally, a housing 2 that distributes vacuum from the suction pipe 3 (not shown in its entirety, but only outlined) of a vacuum cleaner to a suction sole 9 arranged for sweeping a plane 10, such as a floor or the like surface. According to the invention the mouthpiece could also be another type of mouthpiece, such as a wet-suction mouthpiece.

In accordance with the invention the housing 2 is provided with joint connections 8 for receiving an interposed joint 5 which, in turn, is secured via a joint connection 7 to a further joint 4 which, in turn, is secured to the suction pipe of the vacuum cleaner.

Hereby, in principle, the joint connections 7 and 8 form a cardan joint wherein, however, the axes 7*a* and 8*a* are not in the same plane as is the case with conventional cardan joints.

Figure 2:
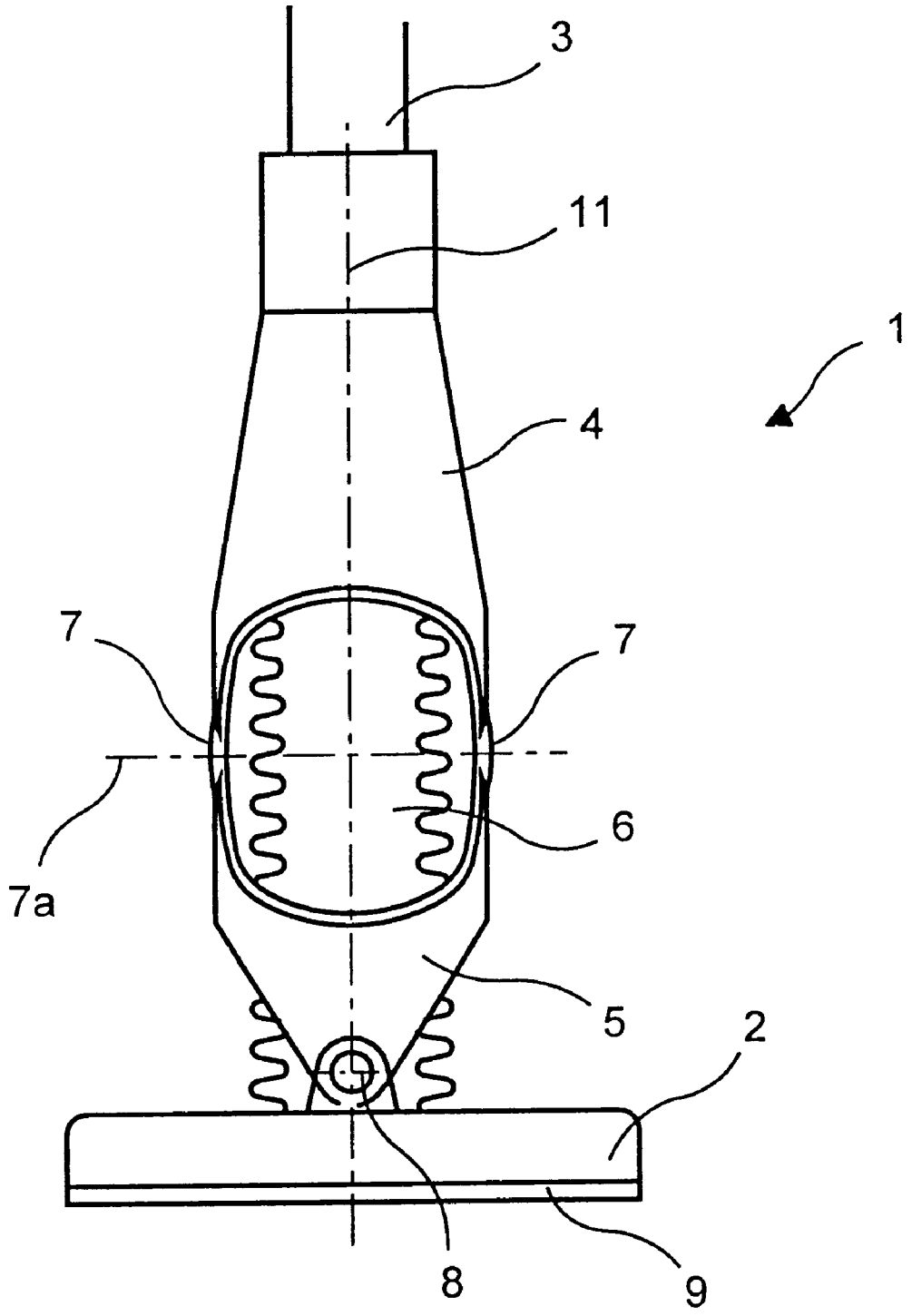
FIG. 2 is a side view of the vacuum cleaner mouthpiece according to claim 1.
Figure 3:
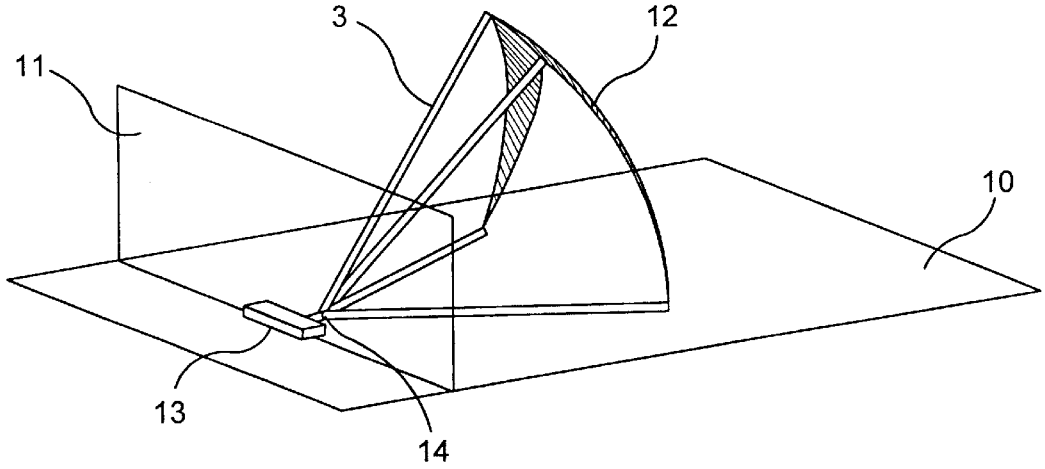
FIG. 3 outlines the operating range of a joint mechanism of conventional type for vacuum cleaners.
Figure 4:
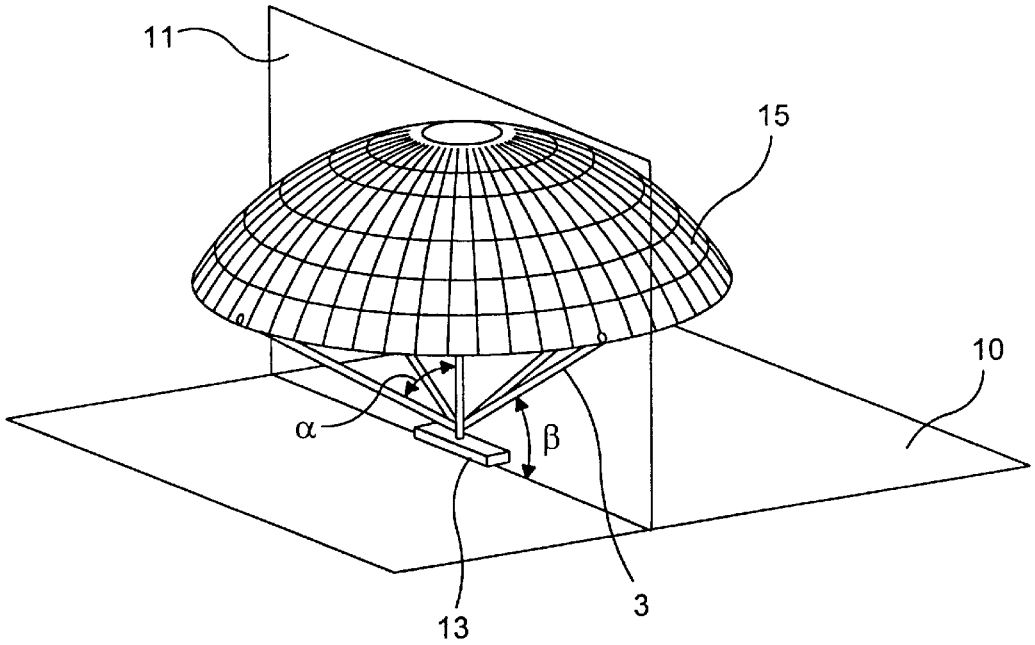
FIG. 4 outlines the operating range for a joint mechanism of the type illustrated in FIGS. 1 and 2.

FIG. 2 illustrates the same vacuum cleaner mouthpiece 1 seen from the side thereby showing that the two joints 4 and 5 are substantially tubular, and that the joint connections 7 and 8 of the joints 4 and 5 are arranged perpendicularly to each other and are perpendicular to the plane 11 which is perpendicular to the abutment surface (10) of the suction sole and extends along and through the elongated suction slot in the suction sole 9.

Combination of FIG. 1 and FIG. 2 will further illustrate that the two junctions 4 and 5 are substantially tubular and that a hose 6 made of a flexible material, e.g. a rubber bellows in the embodiment shown, extends centrally downwards through the two joints 4 and 5.

The hose 6 is so designed that it is capable of transmitting a vacuum from the suction pipe 3 of the vacuum cleaner to the suction sole 9 on the vacuum cleaner mouthpiece 1. Since the securing and arrangement of the hose 6 is obvious to the skilled person and not specifically interesting to the mode of operation concerned by the present invention, this is not illustrated in detail herein, and nor is it shown how the suction ducts to the vacuum cleaner mouthpiece 1 are arranged in the housing 2 and in the suction sole 9. However, the suction sole 9 is in a conventional manner made with one or more suction channels or suctions slots which extend substantially in the longitudinal direction of the housing 2.

Since the cardan joint formed by the joints 4 and 5 and the joint connections 7 and 8 is provided with axes which are perpendicular to each other, and the cardan joint as such is of symmetrical construction, a freedom of movement is established between the housing 2 on the vacuum cleaner mouthpiece 1 and the suction pipe 3 of the vacuum cleaner which is largely symmetrical. Moreover it is obtained during use, when the suction sole 9 sweeps a surface, that a rotation of the housing 2 with the suction sole 9 is brought about which corresponds substantially to a given rotation of the suction pipe 3 of the vacuum cleaner. This rotation may moreover be complete as the cardan joint formed by the joints 4 and 5 and the joint connections 7 and 8 does not restrict such rotation.

Hereby, in particular the hinge connection 8 allows for mutual rotation of the suction pipe 3 of the vacuum cleaner and the joints 4 and 5 outwards to both sides of the plane 11 shown which extends along the suction sole 9. Hereby a working movement is allowed in which the vacuum cleaner mouthpiece 1 may be shifted from side to side relative to the user instead of away from and towards the user as it is known with conventional mouthpieces. In practice, this working movement has proved to provide a quicker and more effective working method in the vacuum cleaning of e.g. floors while simultaneously enabling a more varied and ergonomically convenient work posture.

The latter effect may also be obtained with other joints for connecting the housing 2 of the vacuum cleaner mouthpiece 1 to the suction pipe 3 of the vacuum cleaner without the idea underlying the invention being lost. Thus, a conventional joint for vacuum cleaner mouthpieces may be used provided the joint connection is turned 90° relative to the orientation it has on the known mouthpieces.

Moreover, e.g. a so-called homokinetic joint may be used which may consist of e.g. a ball connection with a ball dish and a ball sliding therein wherein a pin and tongue connection is also provided between the ball dish and the ball for transmitting an angle change therebetween. In principle it will therefore be obvious to the skilled person that any torsionally rigid connection element which allows angle change between the portions connected by the connecting elements may be suitable for this purpose.

In the embodiment shown in FIGS. 1 and 2 the suction pipe 3 of the vacuum cleaner and the joints 4 and 5 as well as the housing 2 are solidly connected to each other whereby this embodiment is specifically aimed at professional cleaning of e.g. large walking areas and the like. In such situations cost-increasing releasable connections may be avoided since they are not necessary for this purpose. If, on the contrary, the vacuum cleaner mouthpiece is intended for use in other contexts, however, it is obvious to the skilled person to establish releasable connections between e.g. the suction pipe 3 of the vacuum cleaner and the joint 4 or between the housing 2 and the joint 5.

What is claimed is:

1. A suction device assembly comprising:

a mouthpiece having a suction sole with an abutment surface defining an abutment surface plane and adapted to engage a plane to be suction cleaned, and an elongated suction slot that debouches on the abutment surface, the mouthpiece defining a plane of reference which is perpendicular to the plane of the abutment surface and extends along with and through the elongated suction slot, a suction pipe having a longitudinal axis, and a connecting element for coupling the mouthpiece with the suction pipe, wherein said connecting element comprises a flexible joint adapted to transmit a change of angle of said suction pipe about said longitudinal axis to a rotation of said mouthpiece in said plane of the abutment surface, the flexible joint providing a range of freedom of movement such that said suction pipe may freely assume different orientations relative to said plane of the abutment surface within the range of freedom of movement, the range of freedom of movement allowing said suction pipe to assume an angle of rotation to both sides of said reference plane about an axis parallel with said suction slot, and further allowing said suction pipe to assume an angle in said reference plane which is less than 80 degrees relative to said plane of the abutment surface, and wherein the flexible joint is adapted in such a manner that a given angle of rotation of said suction pipe about its longitudinal axis causes a substantially equally large angle of rotation of said mouthpiece in said plane of the abutment surface within the whole of said range of freedom of movement.

2. A suction device assembly according to claim 1, wherein the suction pipe can assume an angle of at least 30 degrees to both sides of said reference plane.

3. A suction device assembly according to claim 2, wherein the range of freedom of movement is symmetrical with respect to said plane of reference.

4. A suction device assembly according to claim 3, wherein the flexible joint is of a type which allows said mouthpiece to undergo a change of angle of at least 360 degrees by rotation in said plane of the abutment surface without causing said mouthpiece to be forced out of said plane of the abutment surface, this irrespective of the angle between said suction pipe and said plane of the abutment surface.

5. A suction device assembly according to claim 4, wherein the flexible joint is a homokinetic joint.

6. A suction device assembly according to claim 4, wherein the flexible joint is a cardan joint having two rotational axes.

7. A suction device assembly according to claim 6, wherein the rotational axes of the cardan joint are displaced relative to each other, and wherein the rotational axis which is most proximate to said suction sole extends substantially parallel with said suction slot.

8. A suction device assembly according to claim 7, wherein the cardan joint comprises a tubular element having at the periphery thereof swivel joints to define the two axes of the cardan joint, and wherein a flexible suction hose is provided which extends through the tubular element and connects said suction pipe to said suction slot.

9. A suction device assembly according to claim 1, wherein said connecting element is arranged relative to the suction slot between the extreme ends thereof.

10. A suction device assembly according to any one of the preceding claims, wherein a releasable coupling means is provided between the connecting element and said mouthpiece such as to allow releasable mounting of said mouthpiece on said connecting element.

* * * * *